US006746267B2

(12) United States Patent
Fukamachi et al.

(10) Patent No.: US 6,746,267 B2
(45) Date of Patent: Jun. 8, 2004

(54) COAXIAL CONNECTOR

(75) Inventors: Makoto Fukamachi, Yokkaichi (JP); Naoya Kurimito, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/293,853

(22) Filed: Nov. 13, 2002

(65) Prior Publication Data

US 2003/0109161 A1 Jun. 12, 2003

(30) Foreign Application Priority Data

Dec. 11, 2001 (JP) ..... 2001-37763

(51) Int. Cl.[7] ..... H01R 13/64

(52) U.S. Cl. ..... 439/374; 439/578; 439/675; 439/825

(58) Field of Search ..... 439/247, 374, 439/252, 578, 188, 825, 675, 268, 350, 356, 359–360, 375, 552, 558, 588, 602, 619, 699.2, 823, 850–855

(56) References Cited

U.S. PATENT DOCUMENTS 5,456,611 A * 10/1995 Henry et al. ..... 439/180
5,486,123 A * 1/1996 Miyazaki ..... 439/825
5,595,499 A * 1/1997 Zander et al. ..... 439/352
6,024,609 A * 2/2000 Kooiman et al. ..... 439/675
6,149,448 A * 11/2000 Haller et al. ..... 439/188

* cited by examiner

*Primary Examiner*—Michael C. Zarroli
(74) *Attorney, Agent, or Firm*—Anthony J. Casella; Gerald E. Hespos

(57) ABSTRACT

A housing (30) has a terminal accommodation part (32) for accommodating a terminal (20) and a circular arc wall (34) constituting an insertion opening (36) into which a socket (10) can be inserted. Slits (41) are formed on an upper end of the circular arc wall (34) to form elastic pieces (42). A protrusion (44) projects inwardly on each elastic piece (42) and is disposed to cover an upper portion of each contact piece (25) of the terminal (20). A guide surface (46) inclines inward on each protrusion (44). The lower end of the socket (10) slides on the guide surface (46) so that the socket (10) becomes almost coaxial with the insertion opening (36).

10 Claims, 14 Drawing Sheets

COAXIAL CONNECTOR

BACKGROUND OF THE INVENTION

1. Field of the Invention

The present invention relates to a connector.

2. Description of the Related Art

FIG. 15 shows an example of a connector for use in a harness for connecting an antenna to a receiver mounted on a vehicle body. The connector has a housing 2 that accommodates a terminal 1 connected to a coaxial electric wire W. The housing 2 has an insertion opening 4 that permits insertion of a socket 3 into the housing 2 from above and hence permits electrical connection of the socket 3 to the terminal 1. The terminal 1 is L-shaped and has an inner electric conductor 5 and an outer electric conductor 6 insulated therefrom. A right-hand part of each of the inner electric conductor 5 and the outer electric conductor 6 is connected to a core wire of the coaxial electric wire W and to a shielding layer, whereas a left-hand part thereof is disposed inside the insertion opening 4 and conductive to the socket 3. The left-hand part of the inner electric conductor 5 is erect in the shape of a column, whereas the left-hand part of the outer electric conductor 6 has a plurality of cantilevered contact pieces 7 surrounding the columnar portion of the inner electric conductor 5. The socket 3 can be fitted in the left-hand part of the outer electric conductor 6.

An example of the connector of this kind is described in SE, 503721, C2.

The insertion opening 4 of the above-described connector is open upward. Thus, the contact piece 7 of the terminal 1 is exposed to the upper outside. This construction may cause the socket 3 to strike against the leading end of the contact piece 7 while inserting the socket 3 into the insertion opening 4, if for some reason the socket 3 is dislocated radially from a predetermined position at which the socket 3 matches the insertion opening 4.

The present invention has been made in view of the above-described situation. Accordingly, it is an object of the present invention to prevent deformation of a contact piece.

SUMMARY OF THE INVENTION

The present invention is directed a connector with a housing that has an insertion opening into which a socket can be inserted. A terminal is accommodated in the housing by disposing the terminal in the insertion opening. The terminal has a plurality of contact pieces that are disposed annularly. The socket pieces receive the socket inserted into the insertion opening, and are capable of contacting a peripheral surface of the socket. Protruded portions are formed on an inner peripheral surface of the insertion opening. The protruded portions radially overlap the respective contact pieces and are disposed at a side forward from the contact pieces in an insertion direction of the socket. A guide surface is formed on an outer edge of the protruded portion for guiding the socket to a predetermined position at which the socket matches the insertion opening.

It is preferable that the contact pieces lock to the protruded portions when the terminal is accommodated in the housing at a predetermined depth. Thus, the terminal is held unremovably.

It is also preferable that radially elastically deformable elastic pieces are formed on an end of the insertion opening. The protruded portions are formed on inner surfaces of the respective elastic pieces.

The socket is inserted into the insertion opening, with the terminal accommodated in the housing. Thus, the socket is received in the annular space surrounded with the contact pieces, and the contact pieces contact the peripheral surface of the socket. The socket may be inserted into the insertion opening with the axis of the socket dislocated from the predetermined position. In this situation, the socket slides on the guide surface of the protruded portion before the socket interferes with the contact piece. Thus, the socket is placed automatically at a predetermined position. Accordingly it is possible to prevent the socket from striking against the contact piece, with the socket being uncoaxial with the insertion opening and deforming the contact piece.

The contact piece and the protruded portion are locked to each other. Therefore, it is possible to hold the terminal firmly in the housing.

The elastic piece deforms outward elastically as the terminal presses the protruded portion. Thus a terminal accommodation operation is permitted. The elastic piece returns to its original state when the terminal passes the protruded portion. Accordingly, it is easy to perform the operation of accommodating the terminal in the housing.

DETAILED DESCRIPTION OF THE PREFERRED EMBODIMENTS

Figure 1:
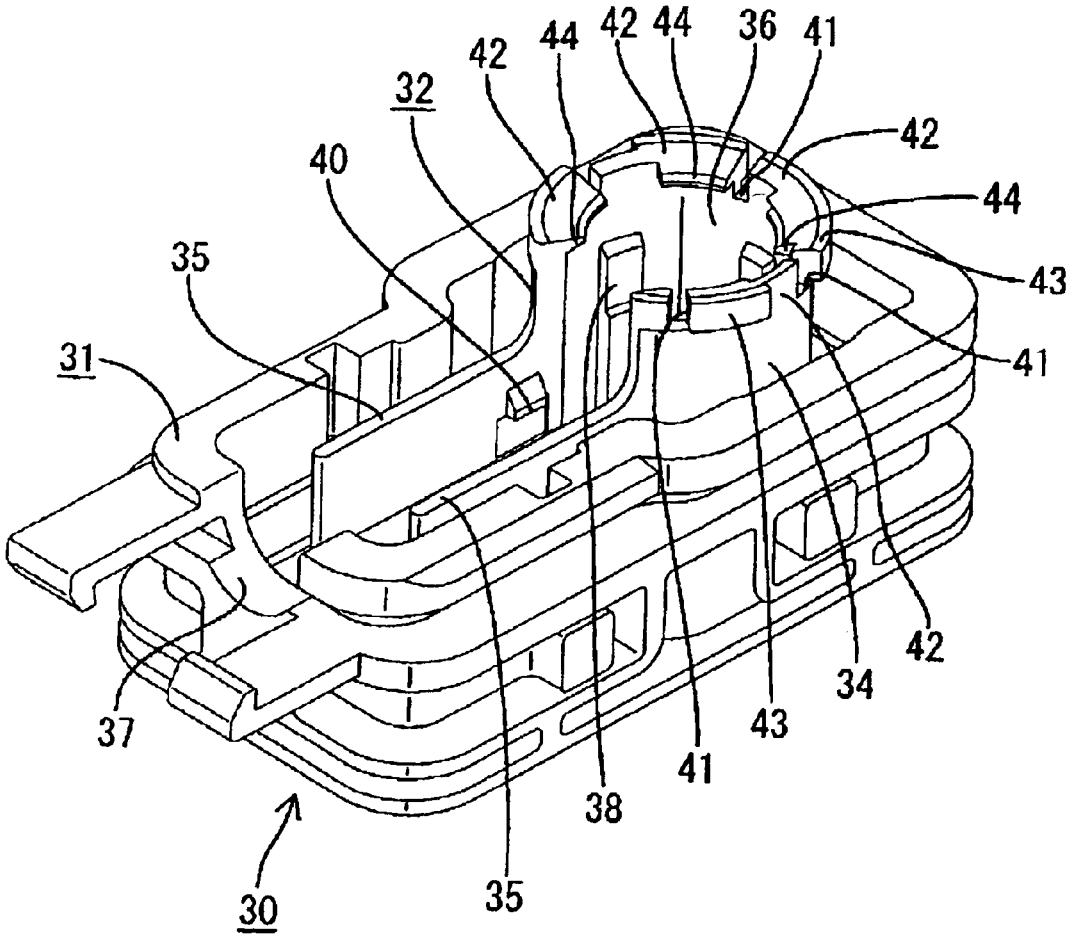
FIG. 1 is a perspective view showing a housing according to an embodiment of the present invention.
Figure 2:
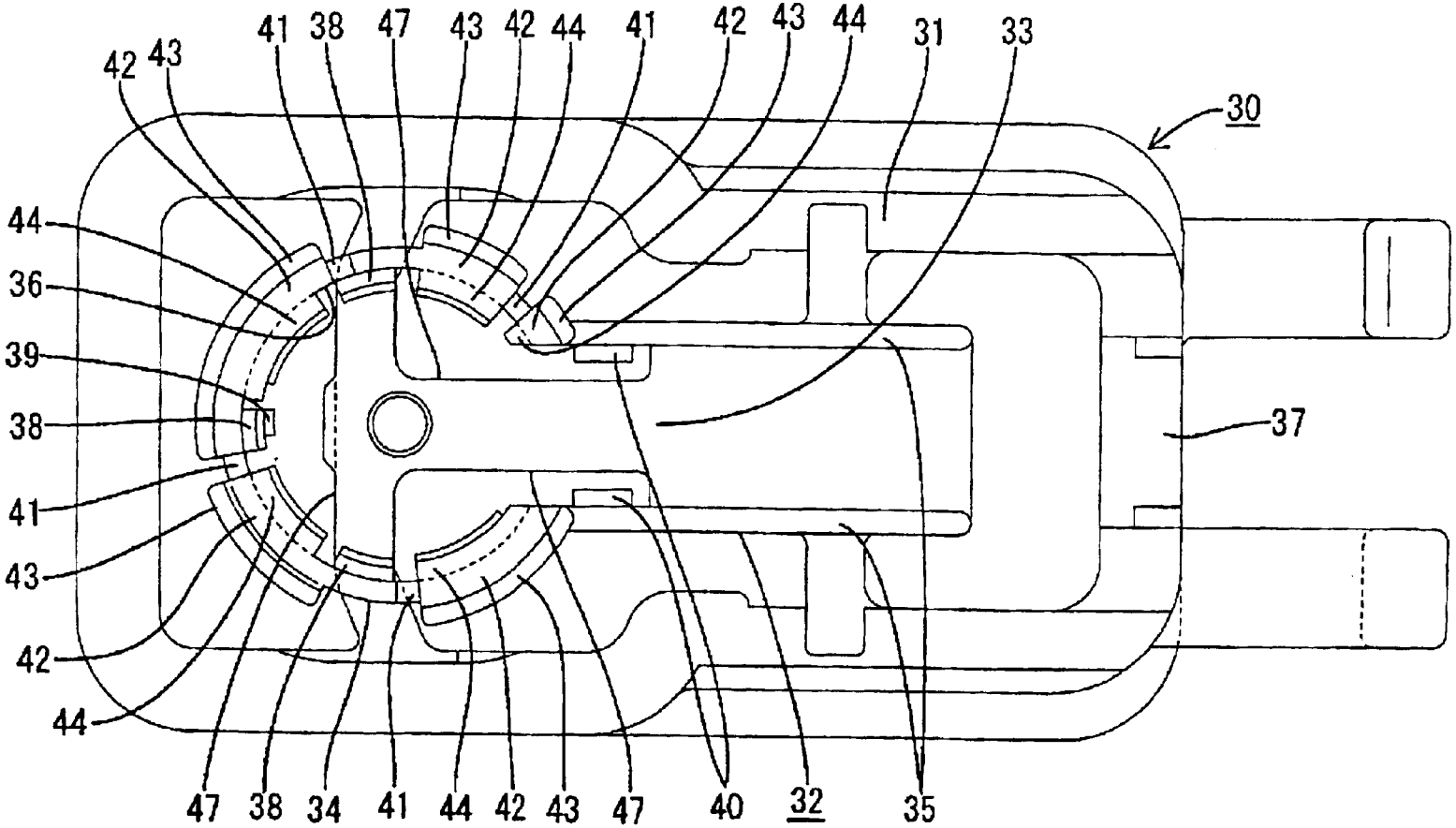
FIG. 2 is a plan view showing the housing.
Figure 3:
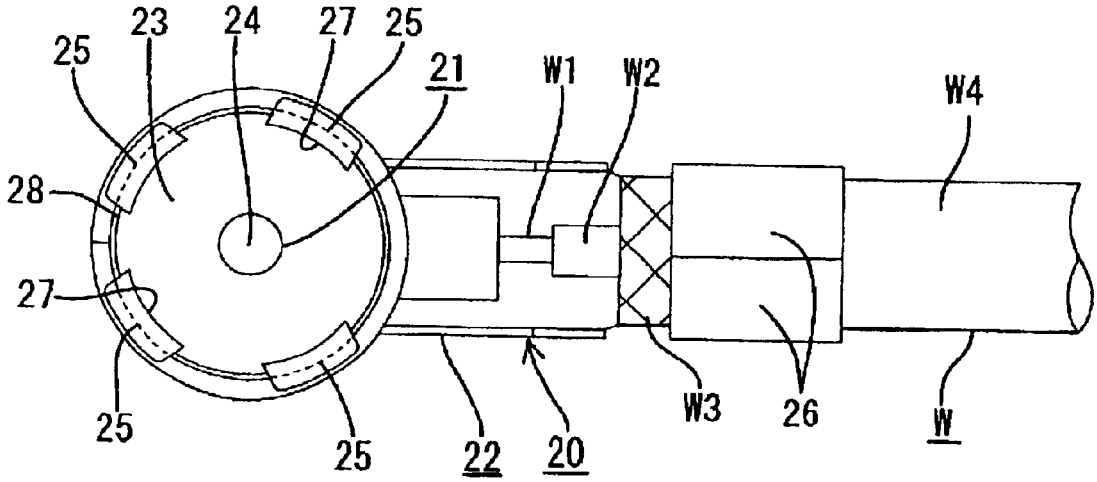
FIG. 3 is a plan view showing a terminal.
Figure 4:
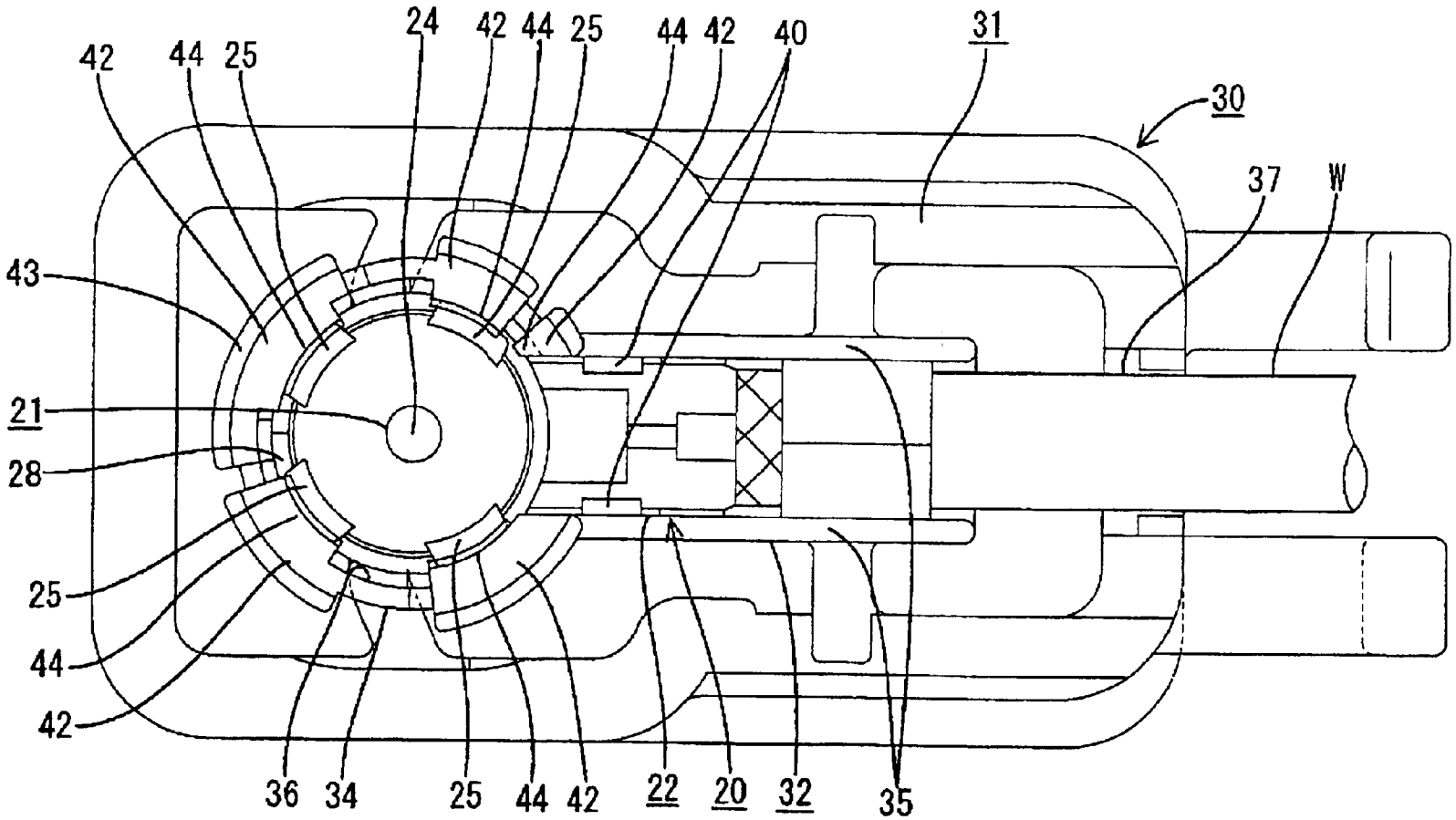
FIG. 4 is a plan view showing a state in which the housing has accommodated the terminal.
Figure 6:
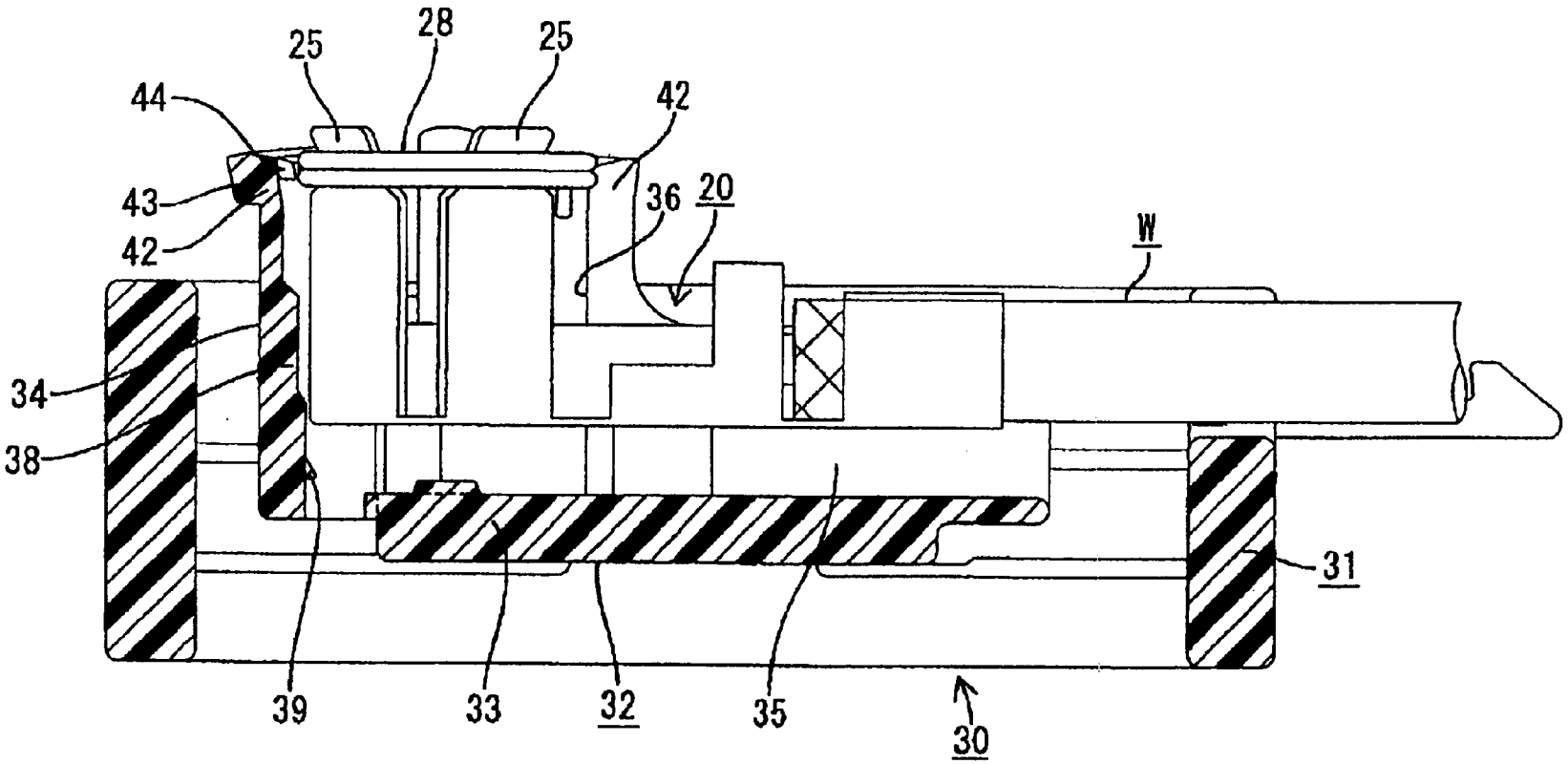
FIG. 6 is a vertical sectional view showing a state in which the housing is accommodating the terminal.
Figure 7:
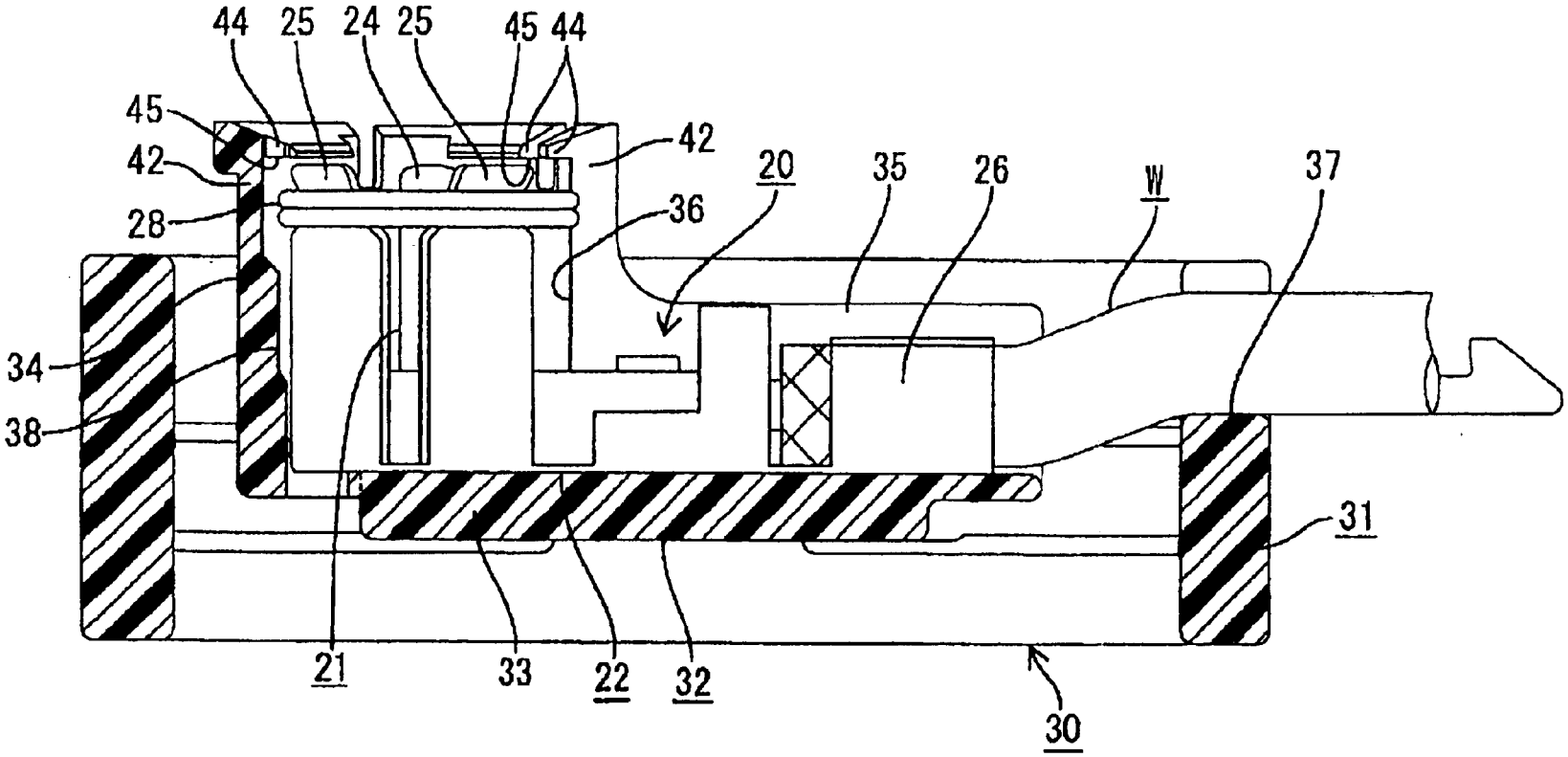
FIG. 7 is a vertical sectional view showing the state in which the housing has accommodated the terminal.

An embodiment of the present invention will be described below with reference to FIGS. 1 through 14. The invention relates to a connector for use in a harness for connecting an antenna and a receiver both mounted on a vehicle body. The connector has a housing 30 into which a socket 10 projecting from a wall surface of a device can be inserted. The connector also has a terminal 20 accommodated in the housing 30 and configured be connected to the socket 10. FIGS. 2 and 7 are set as the reference in the description of right-hand and left-hand directions. Drawings other than FIGS. 2 through 4 are set as the reference in the description of a vertical direction.

Figure 11:
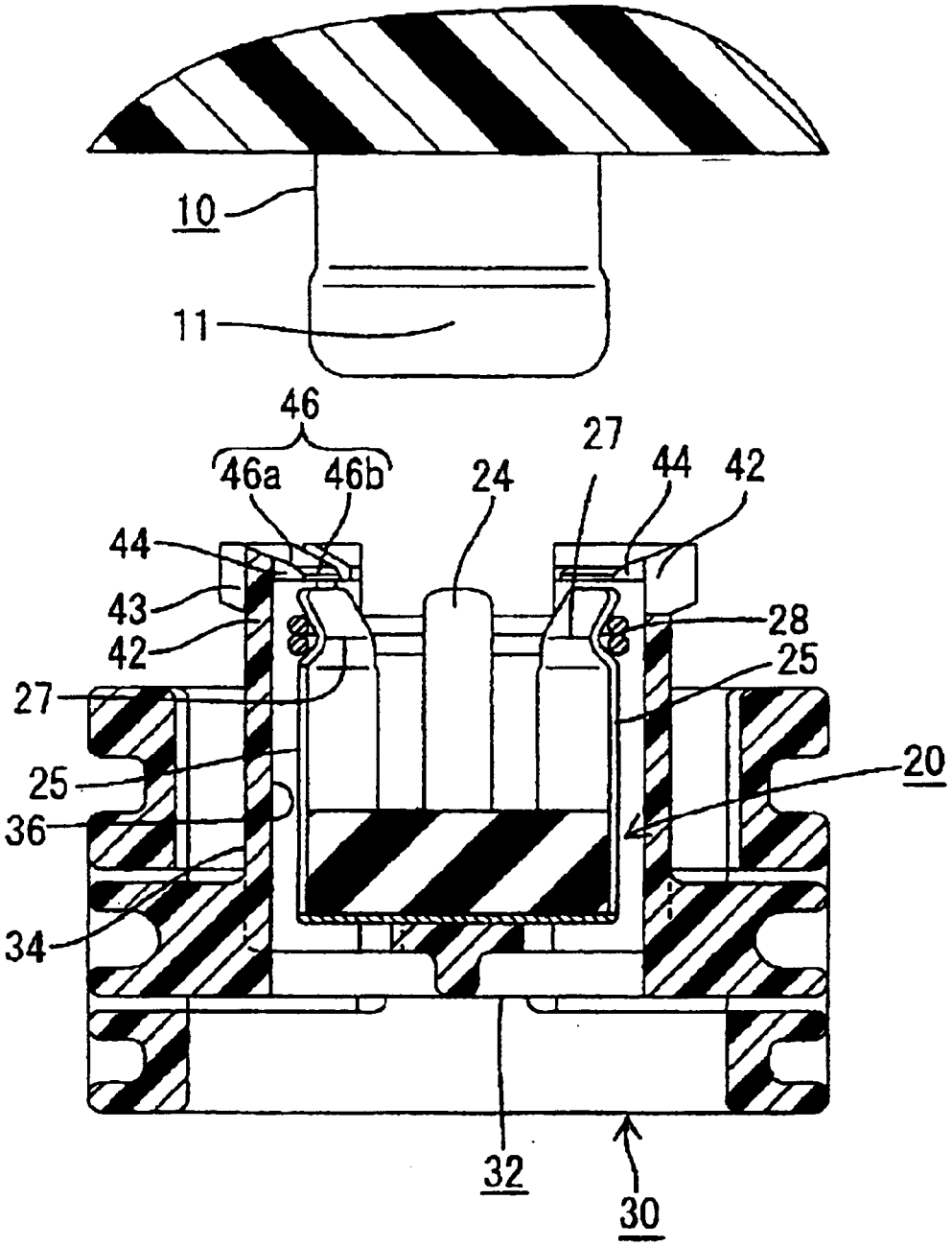
FIG. 11 is a horizontal sectional view showing a state before a socket is inserted into an insertion opening.

As shown in FIG. 11, the socket 10 is approximately cylindrical and has a contact part (not shown) that receives and contacts the inner electric conductor 21 of the terminal 20. The socket 10 also has a contact part 11 that is exposed to the outside and is capable of contacting the outer electric conductor 22 of the terminal 20. The contact part for the inner electric conductor and the contact part 11 for the outer electric conductor 22 are insulated from each other. The contact part 11 for the outer electric conductor 22 defines the peripheral surface of the socket 10. The leading end portion of the socket 10 is stepped outward from the base part thereof and thus has a larger diameter than the base part.

Figure 5:
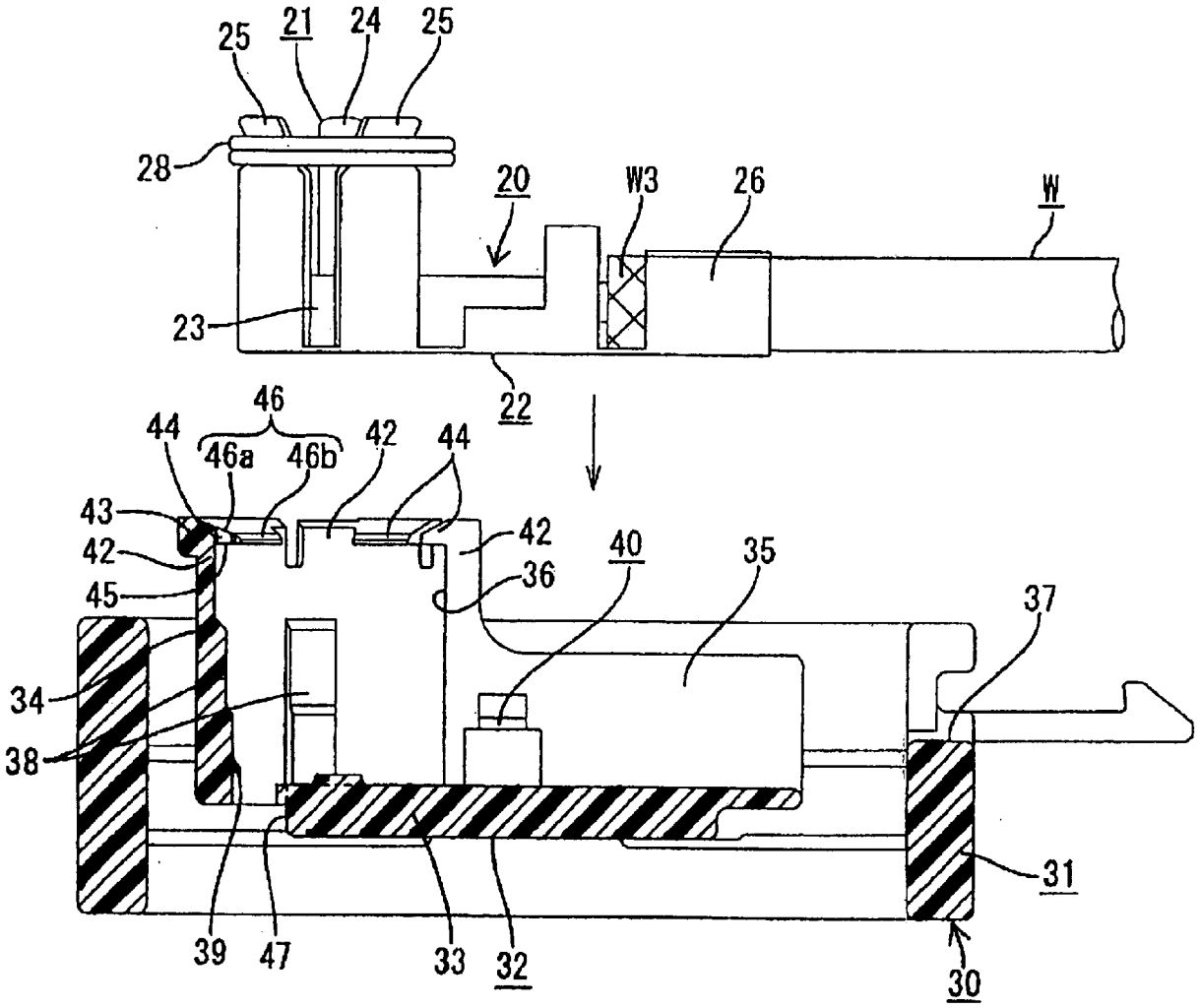
FIG. 5 is a vertical sectional view showing a state before the housing accommodates the terminal.

As shown in FIG. 5, the terminal 20 is approximately L-shaped in a side view. A left-hand part of the terminal 20, extending vertically in FIG. 5, can be connected to the socket 10. A coaxial electric wire W is connected to a right-hand part of the terminal 20 extending horizontally in FIG. 5. The coaxial electric wire W has a core wire W1, an inner coating W2 disposed on the periphery of the core wire W1, a shielding layer W3 that covers the inner coating W2 and an outer coating W4 that covers the shielding layer W3. As shown in FIGS. 3 and 5, the terminal 20 has the inner electric conductor 21 connected to the core wire W1 of the coaxial electric wire W and has the outer electric conductor 22 connected to the shielding layer W3. The terminal 20 also has an insulator 23 interposed between the inner electric conductor 21 and the outer electric conductor 22. A columnar socket-side contact portion 24 projects up from the left-hand portion of the inner electric conductor 21 and is capable of electrically conductively contacting the contact part of the socket 10. An unshown core wire side coaxial electric wire is formed at the right-hand portion of the inner electric conductor 21. The left-hand portion of the outer electric conductor 22 is almost circular in a plan view. Four contact pieces 25 are erected from the periphery of the left-hand portion of the electric conductor, and are capable of electrically conductively contacting the contact part 11, for the outer electric conductor, of the socket 10. The right-hand portion of the outer electric conductor 22 has a pair of caulking pieces 26 for crimped connection to the shielding layer W3 that has been turned back to the outside of the outer coating W4 of the coaxial electric wire W.

The contact pieces 25 are cantilevered and intermittently annularly disposed on the periphery of the left-hand part of the circular outer electric conductor 22. The socket 10 can be received in the space annularly surrounded with the contact pieces 25. Each of the contact pieces 25 has the shape of a circular arc in a plan view so that the shape of the contact pieces 25 conforms to the peripheral surface of the socket 10. The circumferential interval between the right-hand two contact pieces 25 is larger than that between the left-hand two contact pieces 25 in FIG. 3. A portion of each contact piece 25 a little lower than the leading end (free end) thereof is recessed inward to form a contact portion 27 that contacts the socket 10. An elastically deformable elastic ring 28 is mounted on the peripheral side of the contact portion 27 of each contact piece 25 and is fixed thereto by welding or the like. Thus each contact piece 25 is supported so that it does not to the outside. In this manner, an operation of each contact piece 25, which flexes radially inward and outward, is interlocked with an elastically deformable operation of the elastic ring 28.

The housing 30 is made of synthetic resin. As shown in FIGS. 1 and 2, the housing 30 has a rectangular and approximately cylindrical body 31 that opens vertically. A terminal accommodation part 32 capable of accommodating the terminal 20 inserted therein from above is formed in the body 31. The terminal accommodation part 32 has a bottom wall 33 partly connected to the body 31 and a wall part projecting up from the bottom wall 33. The wall part has a circular arc wall 34 (approximately C-shaped) and a pair of straight walls 35 connected to both ends of the circular arc wall 34 and extending in the longitudinal direction of the body 31. The circular arc wall 34 accommodates vertically the socket-side contact portion 24, the contact piece 25, the elastic ring 28 of the terminal 20. The straight wall 35 accommodates horizontally extending portions (caulking piece 26 and the like) of the terminal 20. As shown in FIG. 7, the circular arc wall 34 projects upward beyond the body 31. The socket 10 can be inserted from above into an insertion opening 36 surrounded with the circular arc wall 34. A circular arc-shaped concavity 37 is formed on the body 31 for facilitating pull-out of the coaxial electric wire W inserted between both straight walls 35.

Three guide parts 38 extend from the lower end of the inner peripheral surface of the circular arc wall 34 and function to guide the terminal 20 into the housing 30. Each guide part 38 is formed in the range of about ⅔ of the entire height of the circular arc wall 34. The guide part 38 has an upper portion projecting from the inner peripheral surface of the circular arc wall 34 and a stepped lower portion projecting inward from the upper portion. A tapered surface is formed on the stepped portion of the guide part 38 and is capable of radially guiding the left-hand part of the terminal 20 into the housing 30 from above and to a predetermined position at which the terminal 20 is almost coaxial with the insertion opening 36. The guide parts 38 are disposed at intervals a little smaller than 90 degrees. More specifically, two of the guide parts 38 are disposed in confrontation with each other at the lower and upper sides of the inner peripheral surface of the circular arc wall 34 in FIG. 2. The remaining guide part 38 is disposed at the left-hand side of the inner peripheral surface of the circular arc wall 34 in FIG. 2. A terminal-holding projection 39 is formed on the left-hand guide part 38 in FIG. 2, and is capable of unremovably holding the terminal 20 when the terminal 20 is accommodated at a predetermined depth. A terminal-holding projected portion 40, similar to the terminal-holding projection 39, is formed on the inner peripheral surface of each straight wall 35 for unremovably holding the terminal 20.

As shown in FIG. 1, four slits 41 having a predetermined depth are formed on the upper end of the circular arc wall 34 to form five cantilevered elastic pieces 42. More specifically, except the elastic piece 42 disposed at the upper right-hand side in FIG. 2, the circumferential lengths of the remaining four elastic pieces 42 are almost equal to each other. Each elastic piece 42 is elastically deformable along the radial direction of the circular arc wall 34.

Figure 10:
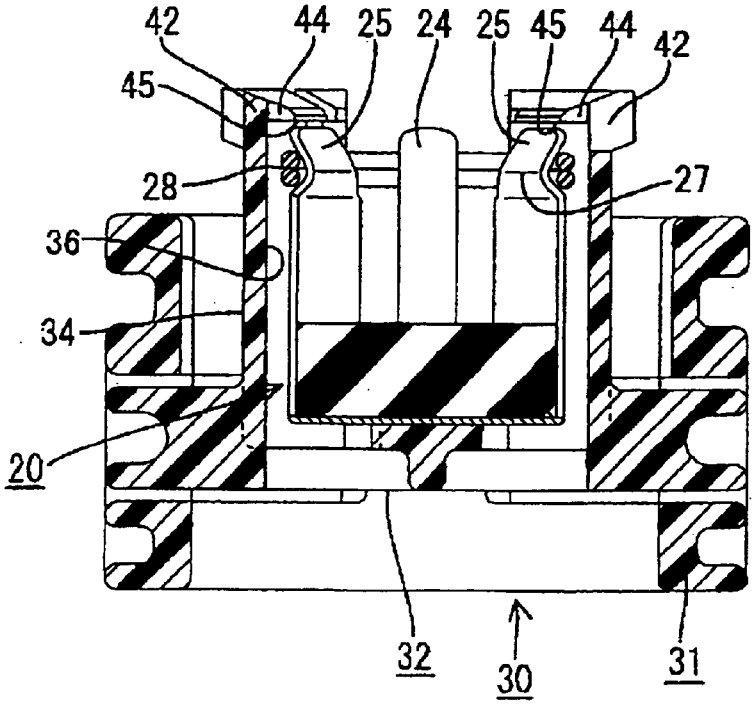
FIG. 10 is a horizontal sectional view showing the state in which the housing has accommodated the terminal.

A receiving portion 43 projects out from the peripheral surface of each elastic piece 42 (see FIG. 13) and is capable of receiving a wall surface of a device when the socket 10 fits on the receiving portion 43. A protrusion 44 projects radially in from the upper end of the inner peripheral surface of each elastic piece 42. As shown in FIG. 4, except the elastic piece 42 at the upper right-hand in FIG. 2, the positions of the protrusions 44 formed on the four elastic pieces 42 correspond respectively to the contact pieces 25 of the terminal 20 accommodated in the insertion opening 36. Thus each protrusion 44 covers an upper portion (front side in socket insertion direction) of the corresponding contact piece 25. The projected length of the protruded portion 44 is set to cover about ⅓ of the peripheral region of the contact piece 25 in its radial direction. As shown in FIGS. 7 and 10, the height of the protrusion 44 is set so that a lower surface 45 of the protrusion 44 is proximate to the upper end of the contact piece 25. The lower surface 45 of the protrusion 44 is locked to the contact piece 25, thus preventing the terminal 20 from being removed upward from the housing 30. The lower surface 45 of the protrusion 44 is an end surface perpendicular to the accommodation direction of the terminal 20.

As shown in FIG. 5, a guide surface 46 is formed on the upper edge of each protrusion 44 and declines inward in the radial direction of the circular arc wall 34. The guide surface 46 has an inclined surface 46*a* having a comparatively gentle inclination formed at its outer side and an inclined surface 46*b* having a comparatively steep inclination formed at its inner side. The gentle inclined surface 46*a* is formed continuously with the upper edge of the elastic piece 42. In inserting the terminal 20 and the socket 10 into the insertion opening 36, the terminal 20 and the socket 10 slide on the guide surface 46. Thus, the terminal 20 and the socket 10 can be guided in their radial directions so that the left-hand part of the terminal 20 and the socket 10 are placed at the predetermined position at which they are almost coaxial with the insertion opening 36. The outer diameter of the elastic ring 28 equals the maximum outer diameter of the terminal 20 and is larger than the inner diameter formed with the inner peripheral surface of the protruded portions 44. Thus, the elastic ring 28 presses the protruded portion 44 outward as the terminal 20 is accommodated in the housing 30. As a result, the elastic piece 42 is flexed outward. A cutting opening 47 is formed on the bottom wall 33 of the terminal accommodation part 32 for a die for molding a material into the protrusion 44, the terminal-holding projection 39, and the terminal-holding projected portion 40 in molding a resinous material into the housing 30.

Figure 8:
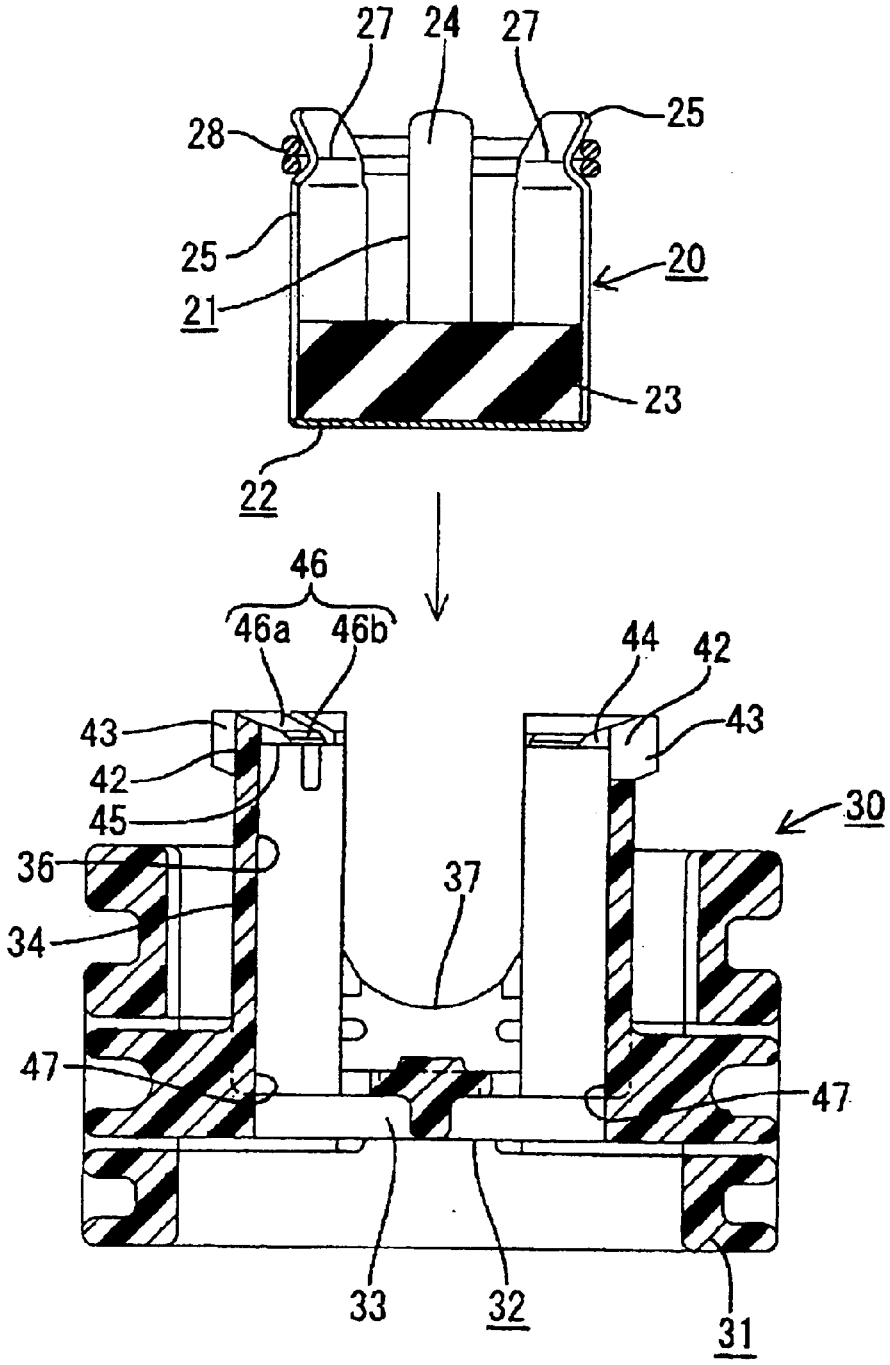
FIG. 8 is a horizontal sectional view showing the state before the housing accommodates the terminal.

Initially, as shown in FIGS. 5 and 8, the terminal 20 connected to the coaxial electric wire W is inserted into the terminal accommodation part 32 from a position above the housing 30. If the left-hand part of the terminal 20 is inserted into the insertion opening 36 with the axis of the left-hand part of the terminal 20 radially dislocated from the axis of the insertion opening 36, the lower end of the terminal 20 slides on the guide surface 46 of each protrusion 44. Thus, the terminal 20 is moved to a position at which the left-hand part of the terminal 20 is coaxial with the insertion opening 36 and penetrates into the insertion opening 36.

Figure 9:
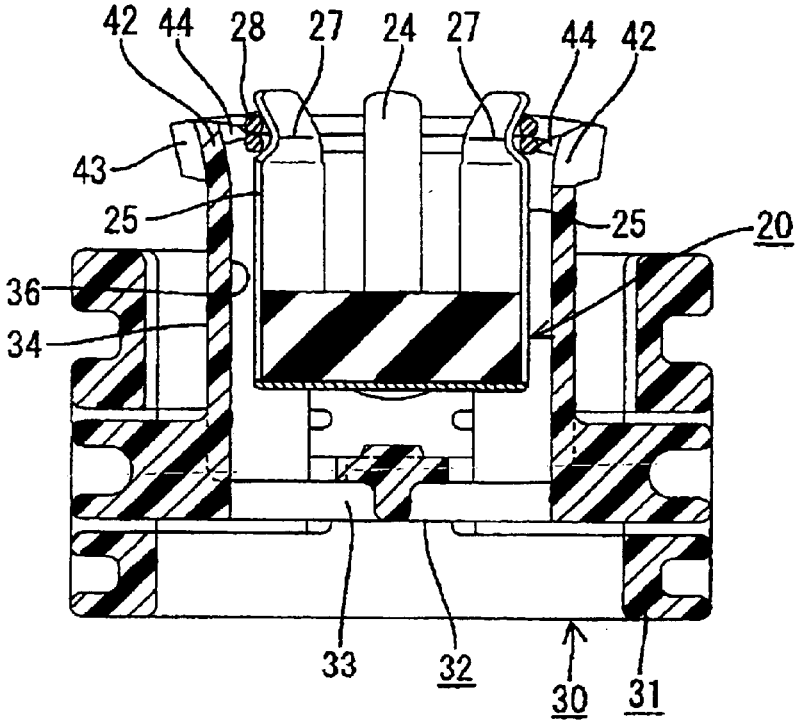
FIG. 9 is a horizontal sectional view showing the state in which the housing is accommodating the terminal.

In the process of inserting the terminal 20 into the insertion opening 36, each protrusion 44 is pressed outward by the terminal 20. Thus, each elastic piece 42 is deformed elastically outwardly. As shown in FIGS. 6 and 9, the elastic piece 42 is flexed the largest amount when the elastic ring 28 presses the protrusion 44. At this time, the left-hand part of the terminal 20 slides on the guide part 38. Accordingly, the terminal 20 is guided to the predetermined position at which the terminal 20 is almost coaxial with the insertion opening 36. When the terminal 20 is inserted into the terminal accommodation part 32 to a predetermined depth, the terminal-holding projection 39 and the terminal-holding projected portions 40 lock the terminal 20 thereto, and the leading end of each contact piece 25 locks the lower surface 45 of each protrusion 44, as shown in FIGS. 7 and 10. As a result, the terminal 20 is held unremovably in the housing 30. At this time, as shown in FIG. 4, the terminal 20 is almost coaxial with the insertion opening 36 due to the guiding by the guide part 38, and the leading end (free end) of the contact piece 25 is covered with and protected by the protrusion 44 disposed above the contact piece 25.

Figure 12:
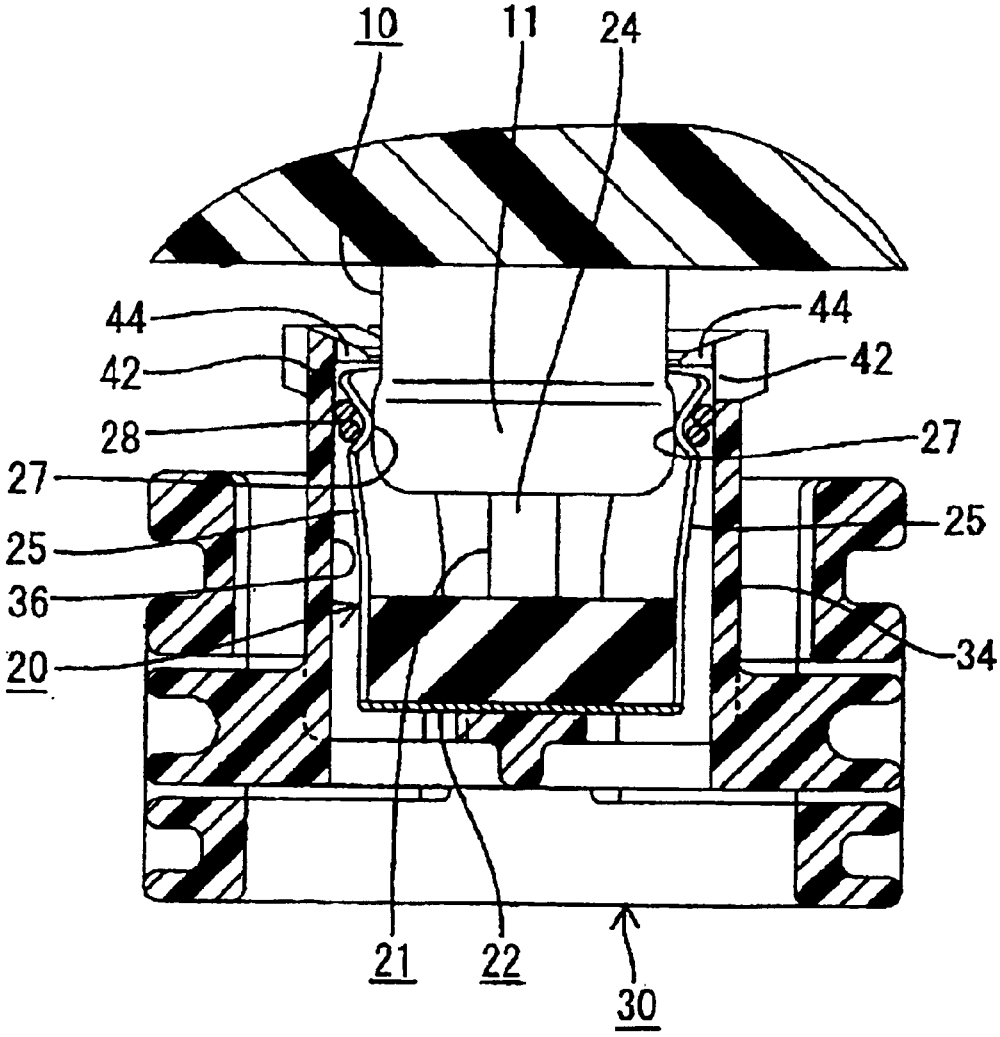
FIG. 12 is a horizontal sectional view showing a state in which the socket is being inserted into the insertion opening.
Figure 13:
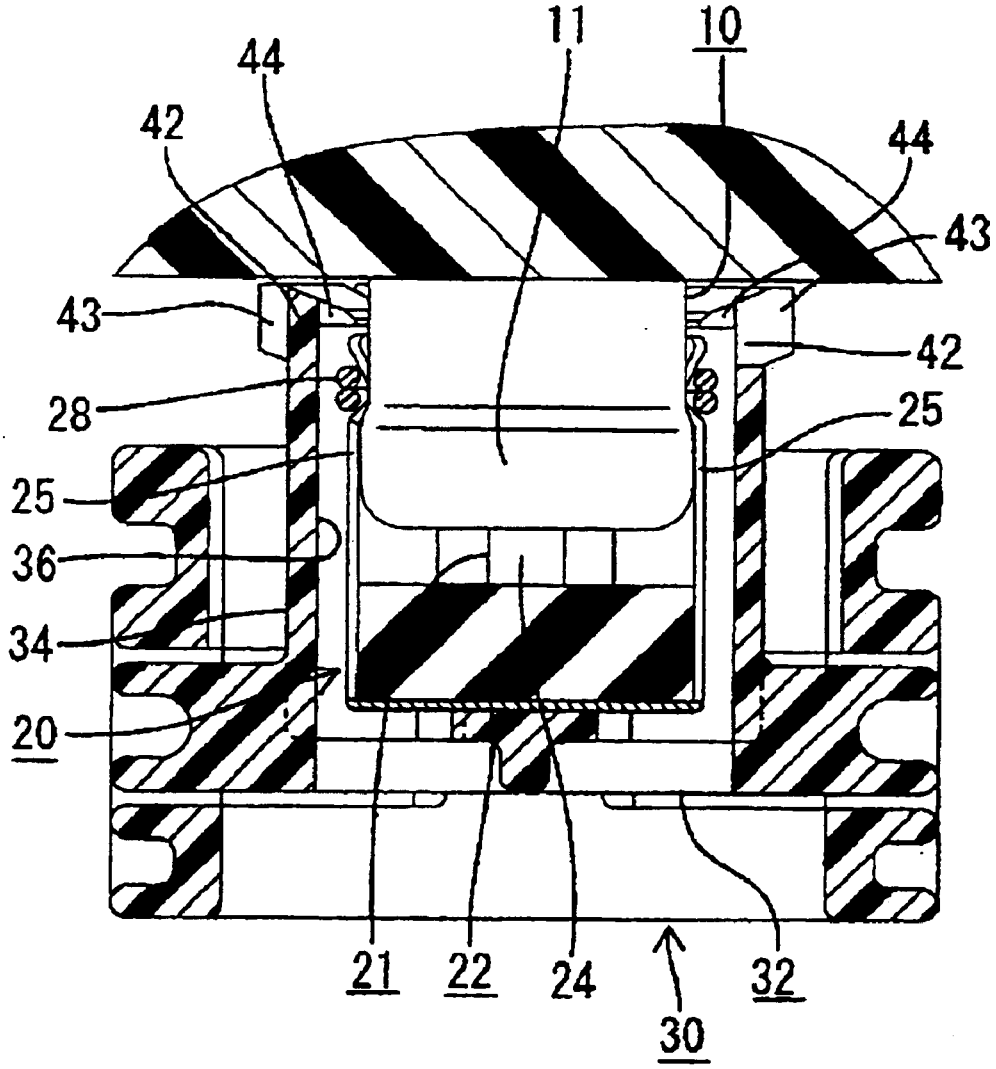
FIG. 13 is a horizontal sectional view showing a state in which the socket has been inserted into the insertion opening in a predetermined depth.

Thereafter, as shown in FIG. 11, the socket 10 is inserted into the insertion opening 36 from a position above the insertion opening 36. When the socket 10 is almost coaxial with the insertion opening 36, the socket 10 penetrates into the space surrounded by the contact pieces 25 and by the protrusions 44. As shown in FIG. 12, the contact portion 27 contacts the large-diameter portion of the contact part 11 of the socket 10. Therefore, each contact piece 25 flexes outward and the elastic ring 28 deforms elastically so that the diameter of the elastic ring 28 increases. The contact part for the inner electric conductor 21 and the socket-side contact portion 24 of the inner electric conductor 21 contact each other and become electrically conductive to each other when the socket 10 is inserted into the insertion opening 36 to the predetermined depth, as shown in FIG. 13, and each contact piece 25 returns to its original state. Consequently, the contact portion 27 of the contact piece 25 and the contact part 11 for the outer electric conductor contact each other and become electrically conductive to each other.

Figure 14:
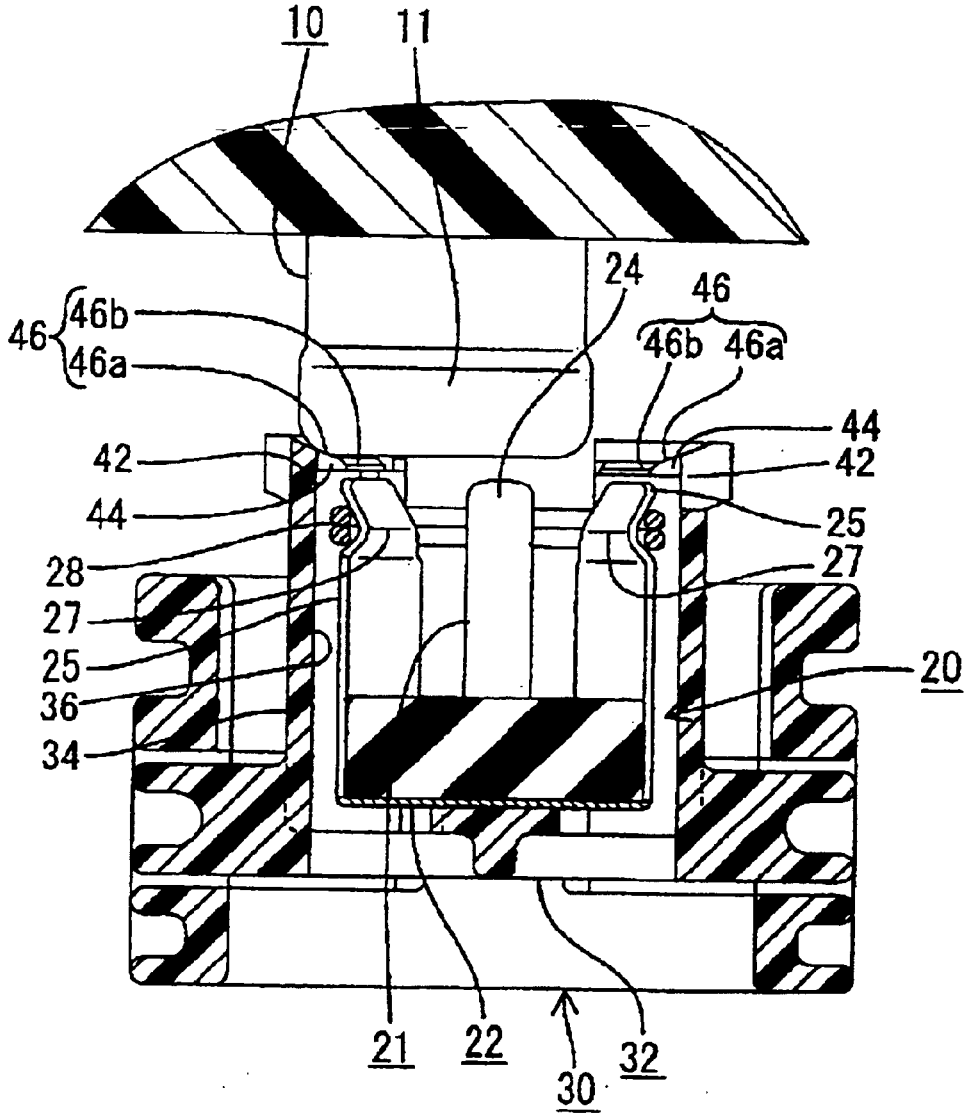
FIG. 14 is a horizontal sectional view showing a state in which the socket uncoaxial with the insertion opening is in contact with a guide surface of a protruded portion.
Figure 15:
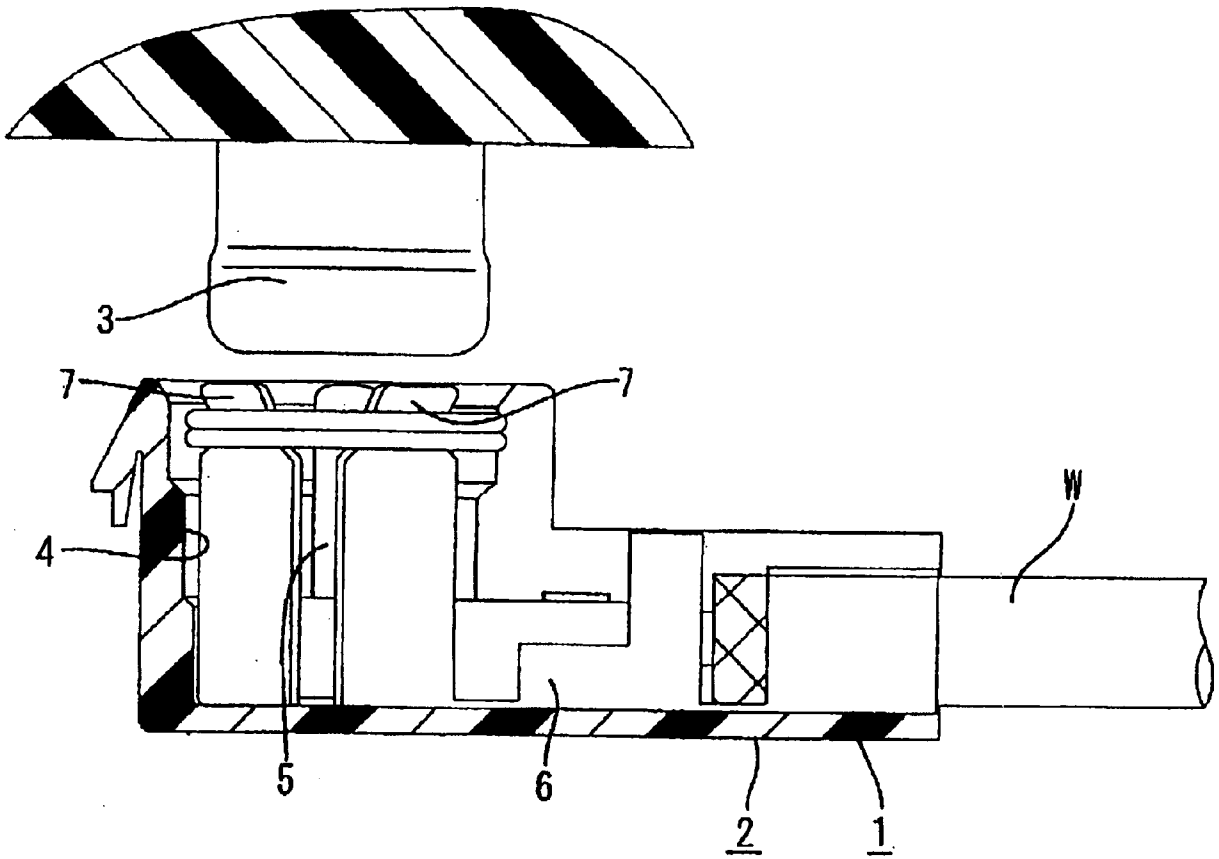
FIG. 15 PRIOR ART
FIG. 15 is a sectional view for describing a conventional art.

On the other hand, the socket 10 may be radially uncoaxial with the insertion opening 36 at a stage before inserting the socket 10 into the insertion opening 36. In this situation, the lower end of the socket 10 contacts the guide surface 46 of the protrusion 44, as shown in FIG. 14. The socket 10 then slides on the gentle inclined surface 46*a* and the steep inclined surface 46*b* as the insertion operation is continued, and the socket 10 is gradually shifted radially inward. When the socket 10 passes the termination (lower end) of the steep inclined surface 46*b*, the socket 10 is at the predetermined position at which the socket 10 is almost coaxial with the insertion opening 36. Therefore the socket 10 contacts the contact portion 27 without directly striking against the leading end of each contact piece 25.

As described above, the protrusion 44 is formed on the inner peripheral surface of the insertion opening 36 in such a way that the protrusion 44 is upward from the contact piece 25, and the guide surface 46 is formed on the outer edge of the protrusion 44. Thus, the guide surface 46 of the protrusion 44 guides the socket 10 to the predetermined position at which the socket 10 matches the insertion opening 36 at a stage before the socket 10 interferes with the contact piece 25. Therefore it is possible to prevent the socket 10 from striking against the leading end of the contact piece 25 and deforming the contact piece 25.

When the terminal 20 is inserted into the terminal accommodation part 32 to a predetermined depth, the contact piece 25 is locked to the lower surface 45 of the protrusion 44. Therefore the terminal 20 is held unremovably in the housing 30.

Further the elastic piece 42 is formed on the edge of the insertion opening 36, and the protrusion 44 is formed on the elastic piece 42. Thus in accommodating the terminal 20 in the housing 30, the terminal 20 presses the protrusion 44 and the elastic piece 42 elastically deforms outward. When the terminal 20 passes the protrusion 44, the elastic piece 42 returns resiliently to its original state. That is, in accommodating the terminal 20 in the housing 30, the elastic piece 42 at the side of the housing 30 is deformed. Thus it is easy to accommodate the terminal 20 in the housing 30 without deforming the terminal 20.

The present invention is not limited to the embodiment described with reference to the drawings, but the following modes are included in the technical scope of the present invention. The present invention can be embodied by making various modifications if they do not depart from the gist of the present invention.

In the above-described embodiment, the protrusion covers and protects the upper portion of the contact piece. However, the protrusion may be formed at a position circumferentially shifted from the position of the contact piece. In this case, the protrusion is placed at an upper position with respect to the position of the contact piece. Thus it is possible to place the socket at the predetermined position before the socket interferes with the contact piece.

In the above-described embodiment, the leading end of the contact piece is locked to the lower surface of the protrusion. However the leading end of the contact piece does not necessarily have to be locked to the lower surface of the protrusion. This construction also is included in the gist of the present invention.

In the above-described embodiment, the terminal is L-shaped. However, the present invention is applicable to a terminal having other configurations, provided that it has the contact piece.

In the above-described embodiment, the socket and the terminal are inserted into the housing in the same direction. However, the socket and the terminal may be inserted into the housing in opposite directions.

What is claimed is:

1. A connector comprising:

a housing having an insertion opening with an opening end into which a socket can be inserted; and a terminal accommodated in said housing by disposing said terminal in said insertion opening, wherein said terminal has a plurality of contact pieces that are annularly disposed receiving said socket inserted into said insertion opening, the contact pieces being capable of contacting a peripheral surface of said socket, and a plurality of protrusions formed on an inner peripheral surface of said insertion opening, said protrusions projecting radially inwardly from portions of said contact pieces closest to the opening end of the insertion opening such that said contact pieces are locked in said insertion opening of said housing by said protrusions; and a guide surface for guiding said socket to a predetermined position at which said socket matches said insertion opening is formed on an outer edge of said protrusion, whereby said terminal is inserted into the housing in an insertion direction corresponding to an insertion direction of the socket and is unremovably held by the protrusions after the insertion to a predetermined depth.

2. The connector of claim 1, wherein each said protrusion has a lower surface engaging one of said contact pieces for holding the terminal in the housing.

3. The connector of claim 2, wherein each said lower surface is aligned substantially perpendicular to the respective elastic piece.

4. The connector of claim 3, wherein each said guide surface includes a gently inclined portion at a radially outer position and a steeply inclined portion radially inwardly from the gently inclined portion.

5. The connector of claim 1, wherein each said protrusion projects inwardly a sufficient distance to cover approximately ⅓ of a top portion of the respective contact piece.

6. A connector, comprising:

a terminal having an axially extending inner conductor and substantially cylindrical outer conductor substantially concentric around the inner conductor, said outer conductor defining a selected outside diameter and a selected height, said outer conductor being defined by plurality of circumferentially spaced contact pieces; and a housing having a bottom wall and a circular arc wall extending up from the bottom wall to a top end defining an insertion opening, said circular arc wall defining an inside diameter at least equal to the outside diameter of the outer conductor and being defined by a plurality of circumferentially spaced elastic pieces, each said elastic piece having an inwardly projecting protrusion spaced from the bottom wall by a distance at least equal to the height of the outer conductor, said protrusions defining an inside diameter less than the outside diameter of the outer conductor, each said protrusion having an inwardly and downwardly sloped guide surface, said outer conductor being engaged in said circular arc wall and held by the protrusions.

7. The connector of claim 6, wherein each said protrusion has a lower surface engaging one of said contact pieces for holding the terminal in the housing.

8. The connector of claim 7, wherein each said lower surface is aligned substantially perpendicular to the respective elastic piece.

9. The connector of claim 8, wherein each said guide surface includes a gently inclined portion at a radially outer position and a steeply inclined portion radially inwardly from the gently inclined portion.

10. The connector of claim 6, wherein each said protrusion projects inwardly a sufficient distance to cover approximately ⅓ of a top portion of the respective contact piece.

* * * * *